US006902459B2

(12) United States Patent
Kim

(10) Patent No.: US 6,902,459 B2
(45) Date of Patent: Jun. 7, 2005

(54) COIN BANK HAVING FUN-TO-USE INTERFACE

(76) Inventor: Kyeong-Hwan Kim, 124-107, Junggye-Siyoung Apt. Junggye-2 Dong, Nowon-Gu, Seoul (KR), 139-785

( * ) Notice: Subject to any disclaimer, the term of this patent is extended or adjusted under 35 U.S.C. 154(b) by 0 days.

(21) Appl. No.: 10/470,959

(22) PCT Filed: Jan. 5, 2002

(86) PCT No.: PCT/KR02/00014

§ 371 (c)(1),
(2), (4) Date: Jul. 30, 2003

(87) PCT Pub. No.: WO02/074125

PCT Pub. Date: Sep. 26, 2002

(65) Prior Publication Data

US 2004/0077251 A1 Apr. 22, 2004

(30) Foreign Application Priority Data

Feb. 2, 2001 (KR) ..... 2001/0002447 U
Jun. 2, 2001 (KR) ..... 2001/0016475 U

(51) Int. Cl.[7] ..... A63H 1/12
(52) U.S. Cl. ..... 446/8; 446/10
(58) Field of Search ..... 446/8, 9, 10, 11, 446/12, 13

(56) References Cited

U.S. PATENT DOCUMENTS 4,664,245 A * 5/1987 Maloy et al. ..... 194/319
4,811,828 A * 3/1989 Gotman et al. ..... 194/351
5,176,380 A * 1/1993 Evans et al. ..... 463/17
5,390,776 A * 2/1995 Thompson ..... 194/346

* cited by examiner

*Primary Examiner*—Derris H. Banks
*Assistant Examiner*—Faye Francis
(74) *Attorney, Agent, or Firm*—Ladas & Parry LLP

(57) ABSTRACT

A coin bank equipped with a recreational function is developed for stimulating an interest in saving money while amusing the children. When a coin is successfully thrown into a target hole, the coins previously thrown and accumulated in the body are drained into a coin bank for storing while performing various amusing events. The coin bank comprises: a body (10) consisting of a target hole (13), a coin receiving part (14) with an open top (11) and a coin outlet (12) for discharging the accumulated coins, a shutter (20) for blocking the coin outlet, a shutter operating mechanism (30), a plurality of transparent pipes (41) vertically extended for supporting the body (10) and used as a coin storing container (40), and a control unit (35) consisting of a driving motor (33), at least one sensor (31), flashing lights (50), voice generators (60) and a dancing doll (70) for performing amusing events.

5 Claims, 8 Drawing Sheets

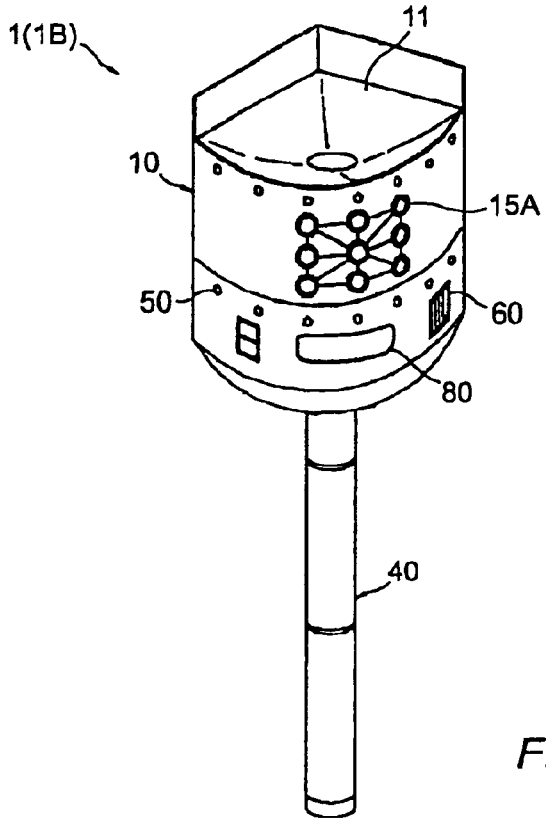
Fig.6
Fig.7
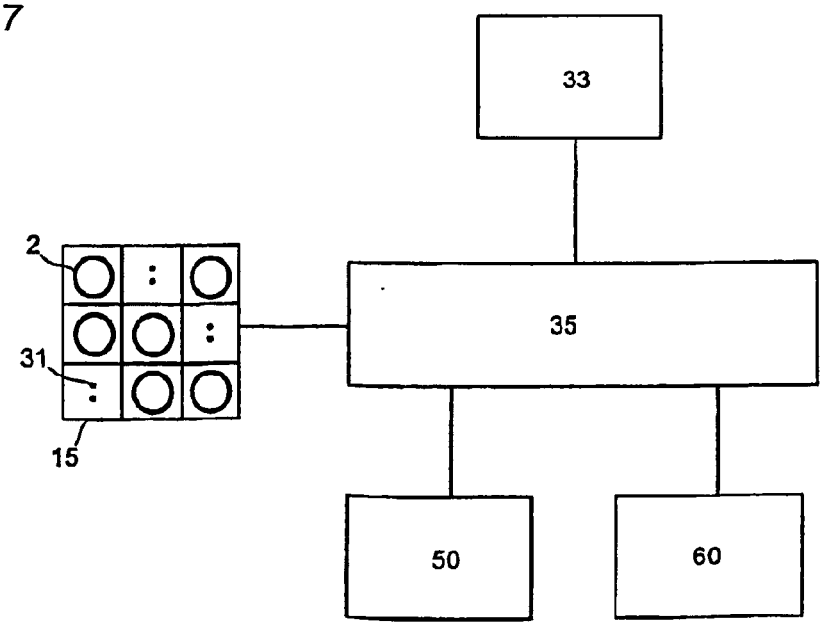

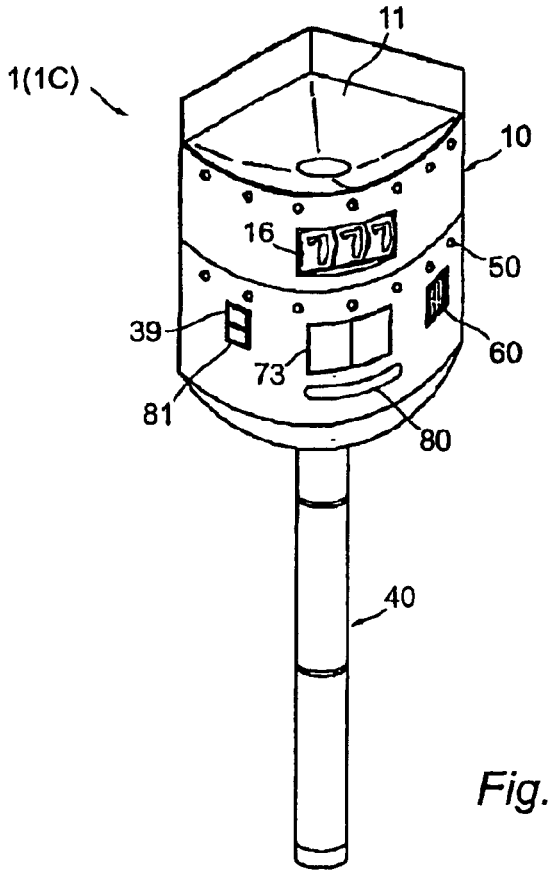
Fig.9
Fig.10
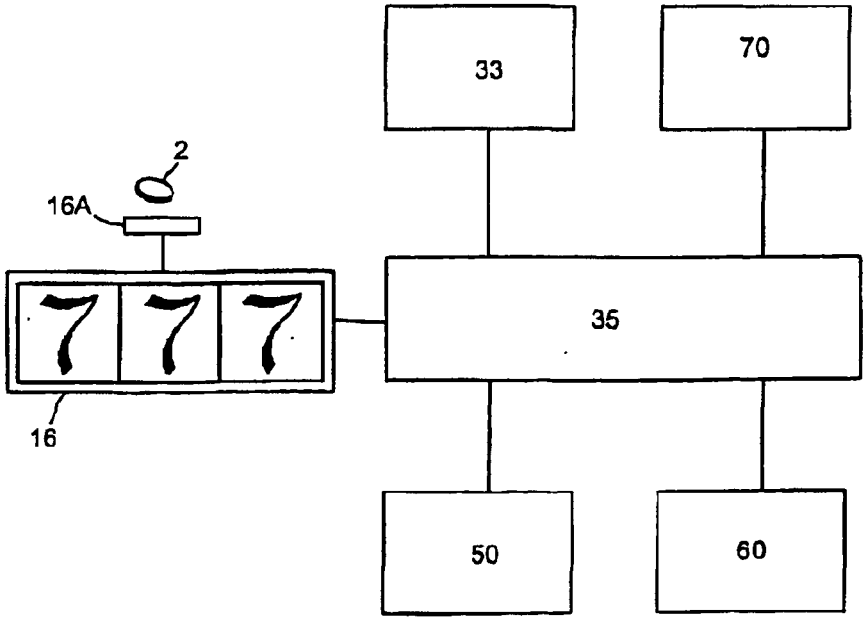

COIN BANK HAVING FUN-TO-USE INTERFACE

BACKGROUND OF THE INVENTION

1. Field of the Invention

The present invention relates to a coin bank equipped with a recreational function. More particularly, the present coin bank provides a simple game: win by throwing a coin into a target hole, or lose the game if the thrown coin misses the target hole. When a player wins the game by throwing a coin into the target hole, the accumulated coins that were previously thrown but missed the target will pour into the saving container.

2. Description of the Prior Art

Generally, a conventional coin bank, such as a "piggy bank" forms a sealed container with a deposit slot at the top. Such a coin bank is used for accumulating coins during ordinary daily life. When the coin bank is fully filled with coins, it cold be opened to assist the home economy. Sometimes, the coins being accumulated in the coin bank could be a great assistance in an emergency situation. Even though a penny is a small amount of money, it is necessary to stimulate children for cultivating an interest in saving at an early age.

However, most conventional coin banks have a container of simple shape or copies of famous cartoon characters for merely storing the coins therein. Further, those shapes of coin banks do not attract any interest or stimulate the children to save money.

Therefore, a coin bank with a limited fun-to-use interface, such as an audio function or a game function is developed for encouraging an interest in saving while amusing the children.

SUMMARY OF THE INVENTION

Accordingly, an object of the present invention is to provide a coin bank having a fun-to-use interface that not only stimulates an interest in saving, but also amuses the children.

Another object of the present invention is to provide a coin bank having a fun-to-use interface that could be used as a toy as well as a coin saving container.

According to a simple playing means of the present invention, a player throws a coin into a target hole, which is located in the middle of the funnel shaped opening, to win the game. If a coin is successfully thrown into the target hole, the winning coin causes the shutter to open and the accumulated coins that have been previously thrown and missed the target hole are poured down into the saving container.

The coin bank of the present invention is comprised of a body, a shutter and a shutter operating mechanism. The body has a funnel shape with a large opening at the top to receive the thrown coins. A coin outlet is formed at the lower part of the body for discharging the coins into the saving container. An operable shutter blocks the coin outlet to accumulate the coins that miss the target hole during the games.

The shutter is connected to the shutter opening mechanism to block or open the coin outlet according to the game result. If a coin goes into the target hole, a control unit activates the shutter operating mechanism to open the shutter and discharge the collected coins from the body. The shutter will automatically block the coin outlet again once all coins have drained.

The rules of the present invention are simple to determine the winning coin. If a thrown coin enters into the target hole, it is a winning coin. If a thrown coin misses the target hole, it will stay on the bottom of the funnel shaped body until a winning coin occurs. It is possible to define different playing means in this mechanism.

In the first embodiment of the present invention, the top surface of the body is divided into two sections: a target hole as a success section, and the rest of the top surface as a failed section. If a player throws a coin into the target hole, he wins the game.

In a second embodiment of the present invention, the bottom of the body includes a bingo game plate that has the same rules as the conventional bingo game. When a coin is thrown into the top opening of the funnel shaped body, the coin will arbitrarily go into a pocket of the bingo plate.

In a third embodiment of the present invention, the body includes a slot machine. When a coin is thrown into the top opening of the funnel shaped body, the thrown coin causes the slot machine to rotate and images or numbers appear on the display, as in the conventional slot machine.

Accordingly, the coin bank of the present invention is further provided with a coin storing container connected to the coin outlet; thereby the coins drained from the body are deposited into the coin container.

The coin bank of the present invention is designed to be installed on the indoor wall in the corner of a recreation room. A player may throw a coin into the opened mouth of the coin bank from a certain distance away to play and save money. At this point, if the coin does not go into the target hole, the thrown coin stays in the bottom of the body. If a coin hits the target hole, the shutter operating mechanism operates to open the shutter, whereby all remaining coins in the body are drained into the saving container.

Preferably, the coin bank of the present invention is also equipped with an additional function, such as an illuminating or flashing light, music or voice generation and doll dancing performance when the accumulated coins are discharged through the coin outlet.

BRIEF DESCRIPTION OF THE DRAWINGS

FIG. 6 is a schematic drawing of a coin bank equipped with a bingo game according to the second embodiment of the present invention.

FIG. 7 is a block diagram for operating a bingo game adapted to the coin bank.

FIG. 9 is a schematic drawing of a coin bank equipped with a slot machine game according to the third embodiment of the present invention.

FIG. 10 is a block diagram for operating a slot machine adapted to the coin bank.

DETAILED DESCRIPTION OF THE PREFERRED EMBODIMENTS

Figure 1:
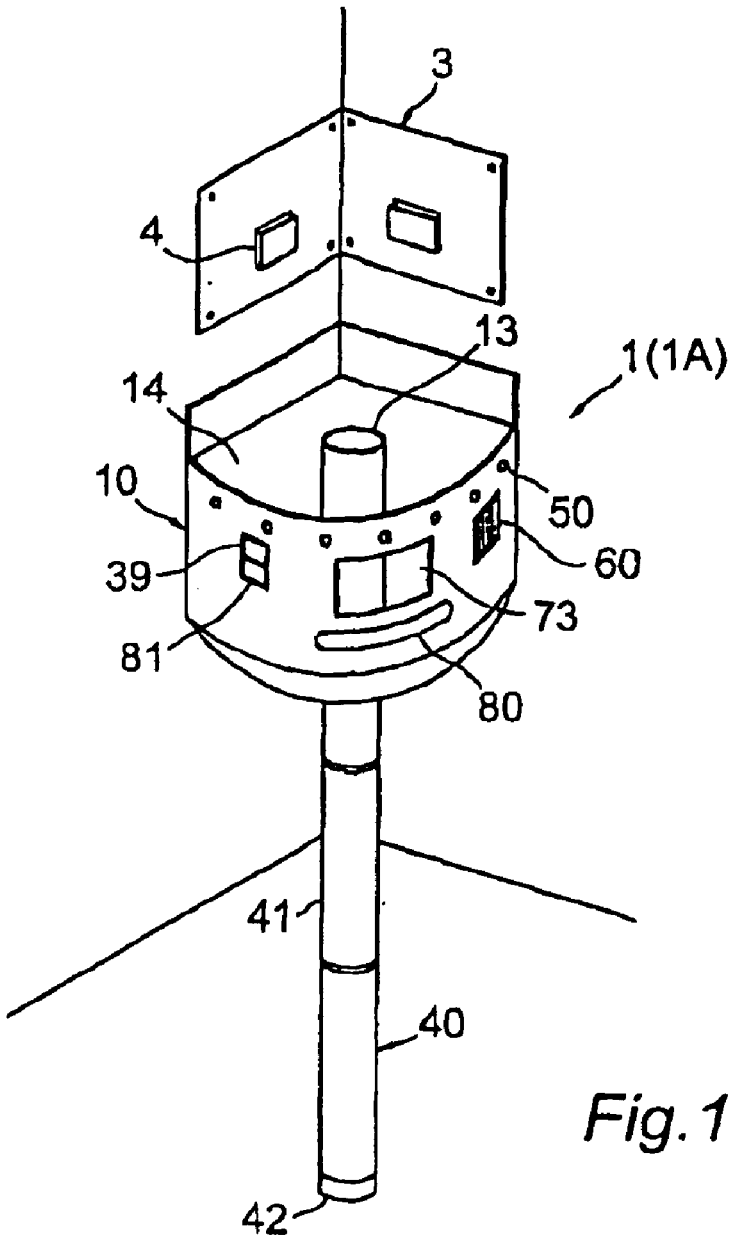
FIG. 1 is a schematic drawing of a coin bank equipped with a coin throwing game according to the first embodiment of the present invention.

As shown in FIGS. 1, 6 and 9, a coin bank 1 of the present invention comprises a body 10 equipped with a game function, a shutter 20 for blocking the coin outlet, and a shutter operating mechanism 30 operated by a control unit.

Figure 2:
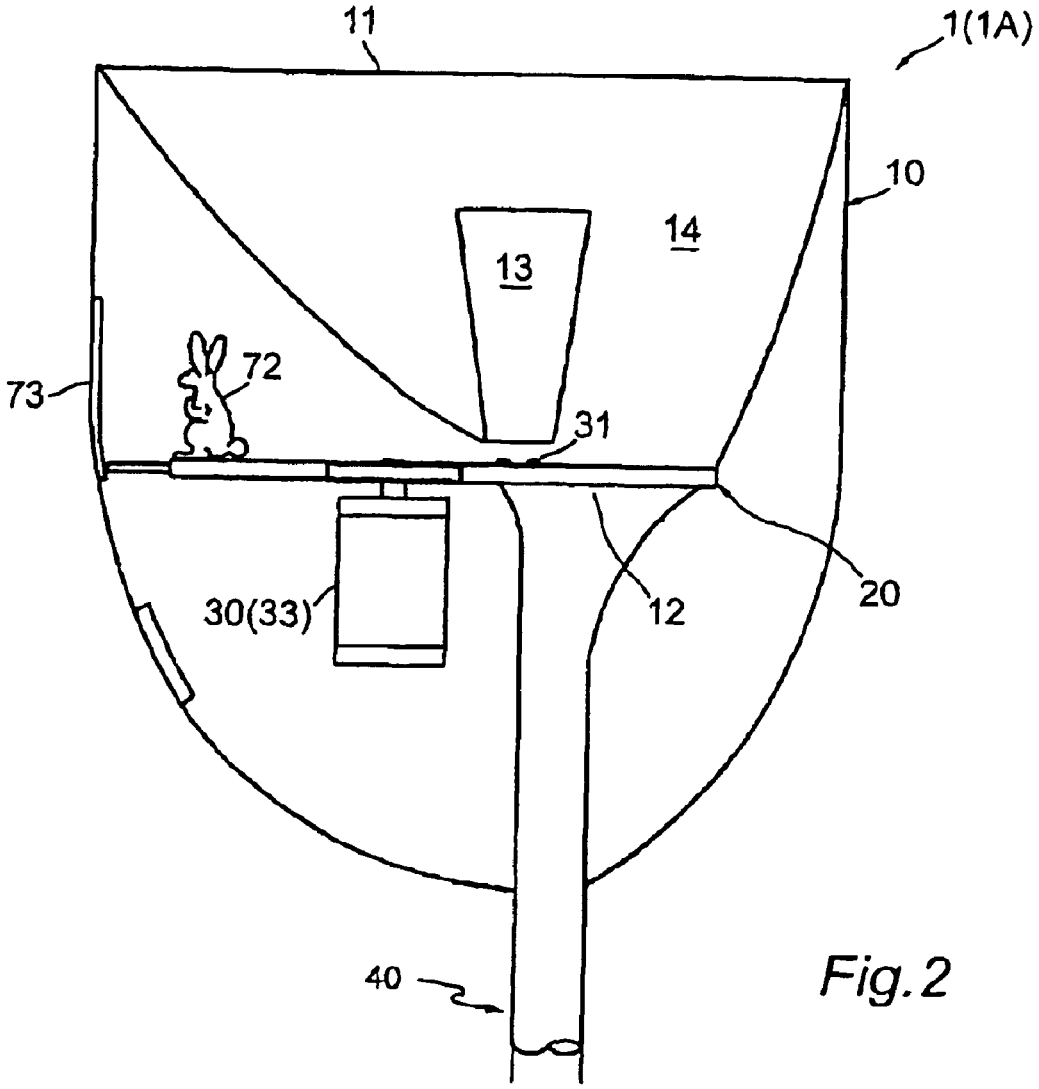
FIG. 2 is a cross-sectional view of the coin bank equipped with the coin throwing game.

The body 10 has an outer shape of a quarter cylinder and an inside shape of a funnel or bowl with an open top 11 for receiving a thrown coin therein. Inside of the body 10, there is a target hole 13 in the shape of a long cup without a bottom. The coin bank 1 also includes a shutter 20 and a shutter operating mechanism 30 as shown in FIG. 2. Preferably, the outer appearance of the body 10 could have a decoration with animal characters to attract the children's interest.

A coin receiving part 14 is the opening at the top of the body 10 for receiving the thrown coin into the coin bank. Preferably, the open top of the coin receiving part 14 is large enough so that any player can easily throw a coin into the body 10 from a certain distance.

A coin outlet 12 is located at the bottom portion of the body 10 of sufficient diameter for discharging the coins.

The coin outlet 12 is ordinarily blocked by the shutter 20. Since the shutter 20 blocks the coin outlet 12, the coins 2 that miss the target hole 13 will collect on the bottom of the body 10.

The shutter 20 is operated by the shutter operating mechanism 30. Namely, if a coin 2 goes into the target hole 13, the shutter operating mechanism 30 actuates the shutter 20, so that the shutter 20 opens and the coins 2 accumulated at the bottom of the body 10 are discharged at once. When the coins are completely discharged, the shutter 20 will be automatically operated by the operation mechanism 30 to block the coin outlet 12 once again.

First Embodiment:

Hereinafter, the first embodiment of the coin bank 1A is explained with reference to the accompanying drawings.

As shown in FIGS. 1 and 2, the body 10 of the coin bank 1A has a target hole 13 as a success section in the middle of the top opening, the rest of which is played as a fail section 14. As a means of playing the game, a player aims and throws a coin 2 toward the target hole 13. If a thrown coin successfully enters the target hole 13, it is considered a winning coin.

On the other hand, if the thrown coin 2 won't go into the target hole 13 and falls into the fail section 14, the coin 2 is simply laid on the bottom of the body 10 without any event. But, if the thrown coin 2 enters into the target hole 13, all accumulated coins on the bottom of the body 10 are discharged from the body 10 into the coin saving container.

The opening area of the target hole 13 is relatively smaller than the open top area of the coin receiving part 14. This means that the frequency of success in the game is relatively less than the frequency of failing. Thus, the area ratio of the target hole 13 to the open top area of the coin receiving part 14 could be adjusted to control the success ratio of the gene by using a different size target hole 13. However, the success section 13 and the fail section 14 are connected to the coin outlet 12 for discharging all accumulated coins 2 into the coin saving container through a chute 40.

There is no restriction on the location of the target hole 13 in the body 10. As seen in the drawings, the target hole 13 can be positioned at the center of the body 10, with the fail section 14 evenly surrounding the target hole 13. Both the success section 13 and the fail section 14 are formed with a conical or funnel shape in which the upper portion is wider than the lower portion, so that the thrown coins 2 easily pass through.

As seen in FIG. 1, the rear portion of the body 10 is formed at a right angle for setting in the corner of the recreation room. In the case where a coin bank 1A is located against a flat wall instead of a corner, the body 10 can be formed in a half-cylindrical shape instead of with right angled rear surfaces.

If a coin bank 1A is hung on the wall, a hanging fixture 3 must be installed on the wall prior to hanging the coin bank 1A. As seen in FIG. 1, a hook 4 is used for hooking the body 10. In this case, a paired hook is formed on the back surface of the body 10.

Because the coin outlet 12 is closed by the openable shutter 20, the coins which did not enter the target hole 13 are retained on the bottom of the body 10 for a while.

A sensor 31 consisting of a pair of contacting points is located on the surface of the shutter 20 for detecting the winning coin that enters into the target hole 13. If a coin enters into the target hole 13, the sensor 31 detects the winning coin. Then, a signal is transmitted to the control unit 35 for activating the shutter operating mechanism 30. Thus, the shutter 20 is opened by the shutter operating mechanism 30.

At this point, the coins 2 accumulated on the fail section 14 are discharged through the coin outlet 12. Once the accumulated coins 2 are discharged, the shutter 20 is restored to its original position to block the coin outlet 12, whereby it is ready to play the next coin throwing game.

As shown in FIG. 2 to 5, the shutter operating mechanism 30 comprises a sensor 31 for sensing the entering coin 2, a rack 32 formed on the shutter 20, a driving motor 33 with a pinion 34 engaged to the rack 32, and a control unit 35 for controlling the overall system.

When the control unit 35 receives a signal from the sensor 31, the control unit 35 actuates the driving motor 33 to open the shutter 20 for a preset time and then promptly close the shutter 20.

In the first embodiment, a pair of contacting points 31 located under the target hole 13 is used as a sensor. In the closed state of the shutter 20, the pair of contacting points 31 disposed under the target hole 13 is electrically disconnected. When a coin enters into the target hole 13, the pair of contacting points 31 is electrically connected for sending a signal to the control unit 35.

Figure 4:
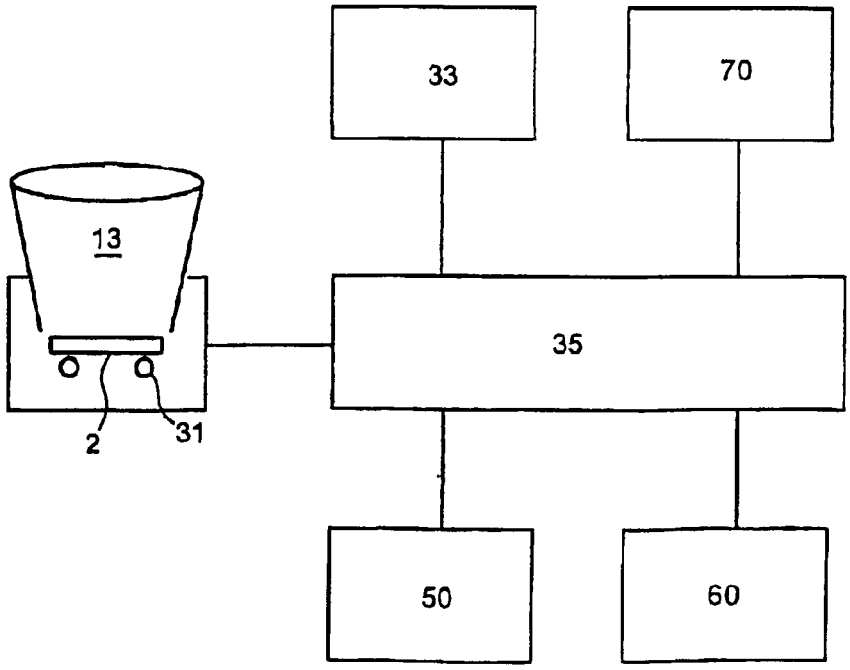
FIG. 4 is a block diagram for operating a shutter mechanism of the coin throwing game.
Figure 5:
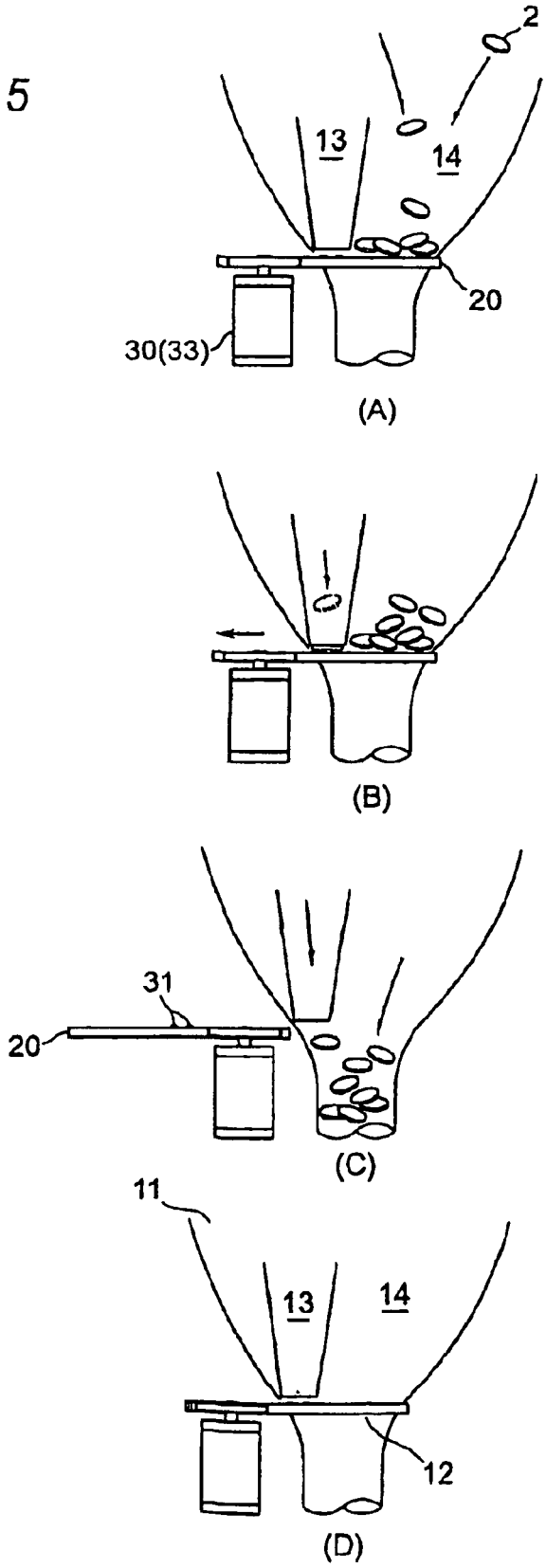
FIG. 5 illustrates the game operating process of the coin bank equipped with the coin throwing game.

Referring to FIGS. 4 to 5, the operation of the shutter 20 and the shutter operating mechanism 30 will be explained in detail.

If a coin does not enter into the target hole 13, the shutter operating mechanism 30 is not activated, and a closed state of the coin outlet 12 is maintained (Refer to A of FIG. 5). When a coin enters into the target hole 13, a pair of contacting points 31 is electrically connected (Refer to B of FIG. 5) and the control unit 35 receives a signal. Then, the control unit 35 will activate the motor 33 to open the shutter 20 for a preset time (the opening time for discharging all coins from the body). Therefore, the coins accumulated in the body 10 are discharged (Refer to C of FIG. 5). After a short time elapses, the control unit 35 activates the motor 33 to restore the shutter 20 to the closed position for the next coin throwing game (Refer to D of FIG. 5).

The configuration of the shutter operating mechanism is not limited to the present shutter mechanism. Other possible configurations of the shutter operation mechanism may be adapted for the same purpose without altering the spirit. That is, the shutter operating mechanism can be adapted to an analog or digital display by combining with the various mechanisms. For example, a servomotor can be used for operating the shutter mechanism while an elastic element, such as a spring can be applied for closing the shutter. Further, another type of driving devices such as a solenoid valve can be used instead of the conventional motor. An optical sensor (e.g. a photoelectric switch) can be used as the sensor 31 instead of the contacting point sensor. Such a combination of the conventional elements with the present configuration of the shutter operating mechanism can be easily accomplished by a skilled person in this art. Therefore, the possible combinations of the configuration are omitted hereinafter.

The coins 2 discharged from the body 10 are stored in the coin storing container 40, which is connected to the coin outlet 12. There is no limit to the shape of the container which can be used for storing the coins.

As shown in FIG. 1, multiple transparent pipes 41 are vertically extended and connected to the coin outlet 12 of the coin bank 1A. The series of multiple transparent pipes 41 form a supporting column and base and can be used as a coin-storing container 40. At this moment, the multiple transparent pipes 41 are coupled and extended to the ground. If a transparent pipe 41 is used as a coin-storing container 40, it can be a visual attraction when the coins are falling from the body 10. The coins accumulated in the coin-storing container 40 can be withdrawn when the owner needs them by disassembling a cap 42 from the end of the transparent pipe 41.

To enhance the visual attraction, the coin bank can include more features, such as a flashing light 50, sound generator 60, dancing doll 70, etc. The activation of the flashing light 50, sound generator 60 and dancing doll 70 along with the shutter operating mechanism 30 are controlled by the control unit 35. That is, when the shutter 20 is operated, the above described elements are activated. For example, while the accumulated coins are falling into the chute, the flashing light 50 will be flashing, the sound generator 60 will say "Congratulations!" and the dancing doll 70 will be swinging around.

The dancing doll 70 is ordinarily hidden inside the body 10. When a coin 2 enters the target hole 13, the dancing doll 10 will appear to celebrate the winning game.

Figure 3:
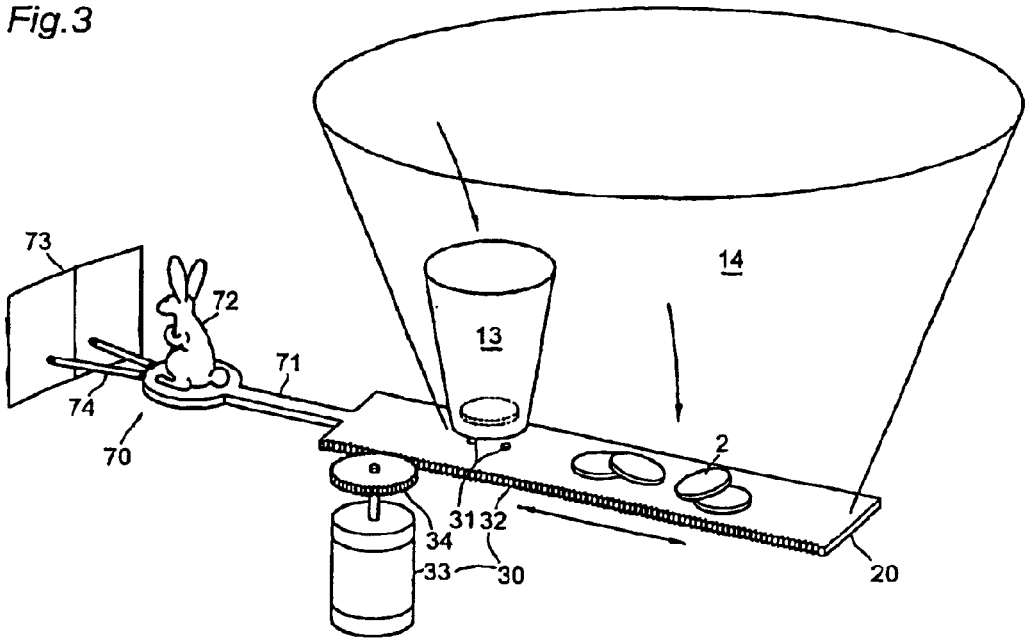
FIG. 3 is a schematic drawing showing a shutter operating mechanism for the coin throwing game.

As shown in FIG. 3, a dancing doll 70 is installed at the tip of the shutter 20. The dancing doll mechanism consists of an extension rod 71 extended from the shutter 20, a dancing doll 72 installed on the extension rod 71, a pair of openable doors 73 installed in front of the dancing doll 72 and a pair of links 74 connected to the extension rod 71 and the pair of doors 73 set on a hinge pin. The dancing doll 70 is operated simultaneously with the shutter 20.

Accordingly, when a coin 2 enters the target hole 13, the shutter 20 is moved towards the open position. Simultaneously, the extension rod 71 is moved in the direction of the doors 73. The pair of links 74 is swiveled to push open the hinged the doors 73. Then, the dancing doll 72 appears from the inside of the body 10 and performs a certain action. The structure and operation of the dancing doll mechanism could be adapted from that of the conventional dancing doll because the technology is already well known in this art.

When the shutter 20 is moved toward the closed position, the extension 71 is moved away from the door 73. Then, the dancing doll 72 is retracted into the body 10, and the pair of links 74 is swiveled back to close the door 73.

An additional sensor (not shown) may be installed in the fall section 14 for detecting the incoming coins 2. If the coin comes into the fail section 14, a recorded message says "Sorry! Try again!"

An illuminating light or a flashing light 80 may be added to the coin bank 1A to provide exciting effects. When the shutter is operated by the shutter operation mechanism 30, the flashing light 80 will be flashing with various color lights in all directions irregularly. A switch 81 is separately installed for controlling the coin bank lights from a main power switch 39.

Second Embodiment

Figure 8:
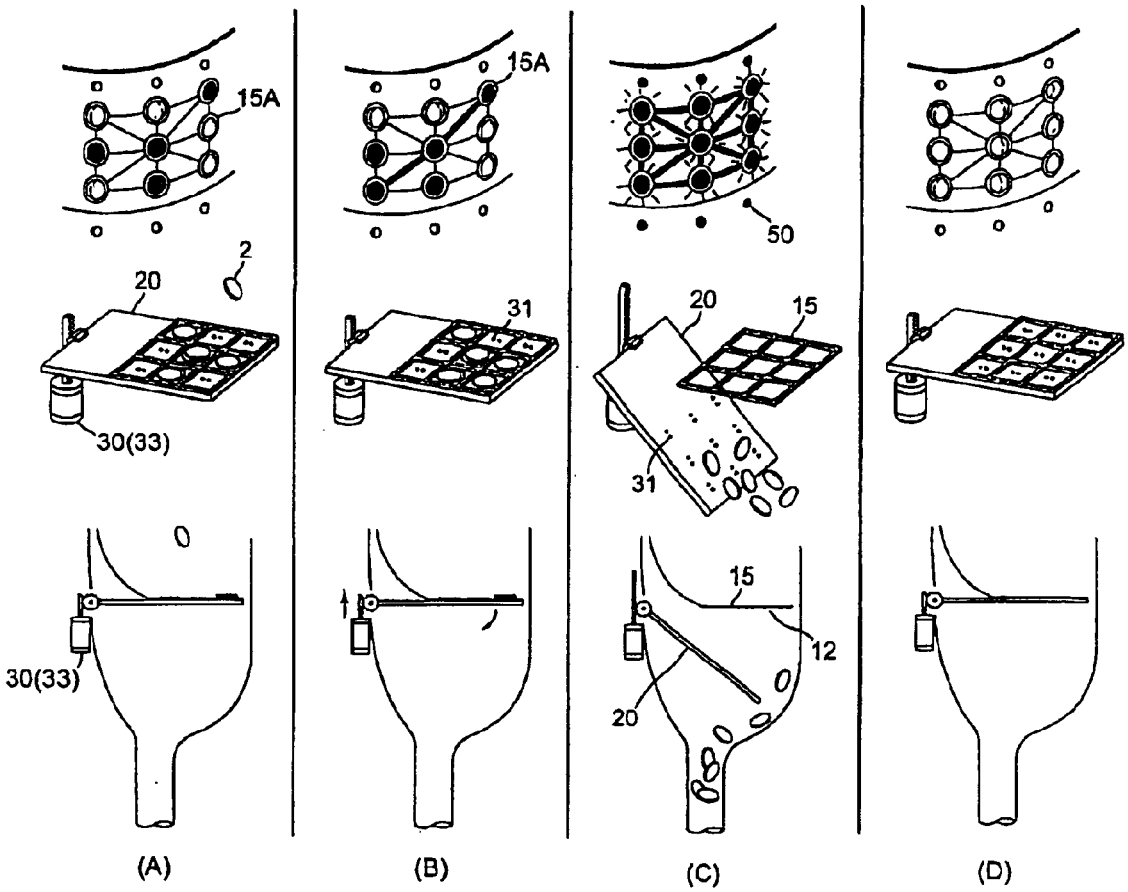
FIG. 8 illustrates an operating process of the bingo game adapted to the coin bank.

According to a second embodiment of the present invention, the coin bank 1B is hereby presented with reference to FIGS. 6 to 8. The coin bank 1B comprises a body 10, a shutter 20 and a shutter operating mechanism 30.

In the coin bank 1B, the body 10 includes a bingo game section 15 instead of the target hole as a success section 13 and the open area as a fail section 14. In this embodiment of the present invention, the coin 2 is thrown by the player. The thrown coin will enter into a grid of the bingo game plate section 15 is an arbitrary manner.

That is, if a coin 2 does not enter the bingo grid plate, it falls into the bottom of the body 10. But if the coins 2 enter the bingo grid plate 15 and form a bingo state, the collected coins are discharged from the body 10.

As well known to the public, the bingo game uses a 5×5 bingo grid plate with arbitrary numbers from 1 to 75 printed in the 24 grid sections except the center grid. When the numbers are randomly drawn, the players match the 5 series number in a vertical, horizontal or diagonal direction on their bingo game plate.

However, the coin bank 1B of the present invention adopts a simplified bingo game grid plate (actually, tic-tac-toe) that has 3×3 grid sections 15 with printed arbitrary numbers to increase the probability of winning. In this case, if the thrown coins enter into three series grids in a vertical, horizontal or diagonal direction on the bingo game plate, the game is won.

The coin outlet 12 is located below the bingo grid plate 15. A shutter 20 that blocks the coin outlet 12 is located between the bingo plate 15 and the coin outlet 12. The operation of the shutter 20 is performed by the shutter operation mechanism 30.

In the second embodiment of the present invention, the bingo game plate 15 is located on the shutter 20 in the horizontal direction. Alternatively, the bingo plate or bingo display 15 may be positioned in the vertical direction.

The shutter operating mechanism 30 includes a plurality of contacting point sensors 31 for detecting the entrance state of the coins into the bingo grid plate 15. There is one sensor 31 installed in each grid section to detect whether a coin enters into each corresponding grid of the bingo plate 15. If the entered coins satisfy the winning condition as described above, the control unit 35 receives a signal from the sensors to activate the shutter operation mechanism 30. In addition, a display panel 15A corresponding to the bingo grid plate 15 is installed in the front surface of the body 10 to easily see the game status. Each indicating light 15A will light up when a coin goes into the corresponding grid section.

In this second embodiment, the configuration of the shutter operating mechanism 30 for operating the shutter 20 is not limited. As an example, the shutter 20 can be a hinged door to the body 10. Thus, the shutter operation mechanism 30 can tilt down the shutter 20, so that the coins will fall down to the chute.

The shutter operating mechanism 30 of the second embodiment consists of multiple sensors 31 installed on the surface of the shutter 20, a driving device 33 such as a solenoid valve for tilting the shutter 20 and a control unit 35.

According to the signal of the sensors 31, the control unit 35 operates the driving device 33 to open the shutter. When the sensors 31 detect the winning bingo state, the shutter 20 is tilted for a preset time to allow all accumulated coins to fall down.

Referring to FIGS. 7 and 8, the operation of the shutter 20 and the shutter operating mechanism 30 is described in detail. If a coin 2 enters a bingo grid section 15, a sensor 31 installed at the corresponding bingo grid section detects the entering the coin and turns on the light for the corresponding bingo grid section. At this moment, the shutter 20 maintains the closed state of the coin outlet 12 (Referring to A of FIG. 8). However, the control unit 35 will not activate the motor 33 until it receives a winning signal from the detectors. The winning signal will be issued when a series of three bingo grid sections are occupied in the horizontal, vertical or diagonal direction. Then, the control unit 35 starts to operate the shutter operating mechanism 30 (Refer to B of FIG. 8).

The control unit 35 operates the driving device 33 to tilt down the shutter 20 for a while (to allow all coins to fall down from the body), so that the coins accumulated on the bottom of the body 10 fall down (Refer to C of FIG. 8).

After a short time elapses, the control unit 35 reverses the driving device 33 to restore the shutter 20 to the original position. Thereby, it is ready to play the next game (Refer to D of FIG. 8).

The coin bank 1B is also equipped with a flashing light 50, a second generator 60, a dancing doll 70, etc. for demonstrating the various events in the same manner as the previous embodiment.

Third Embodiment

Figure 11:
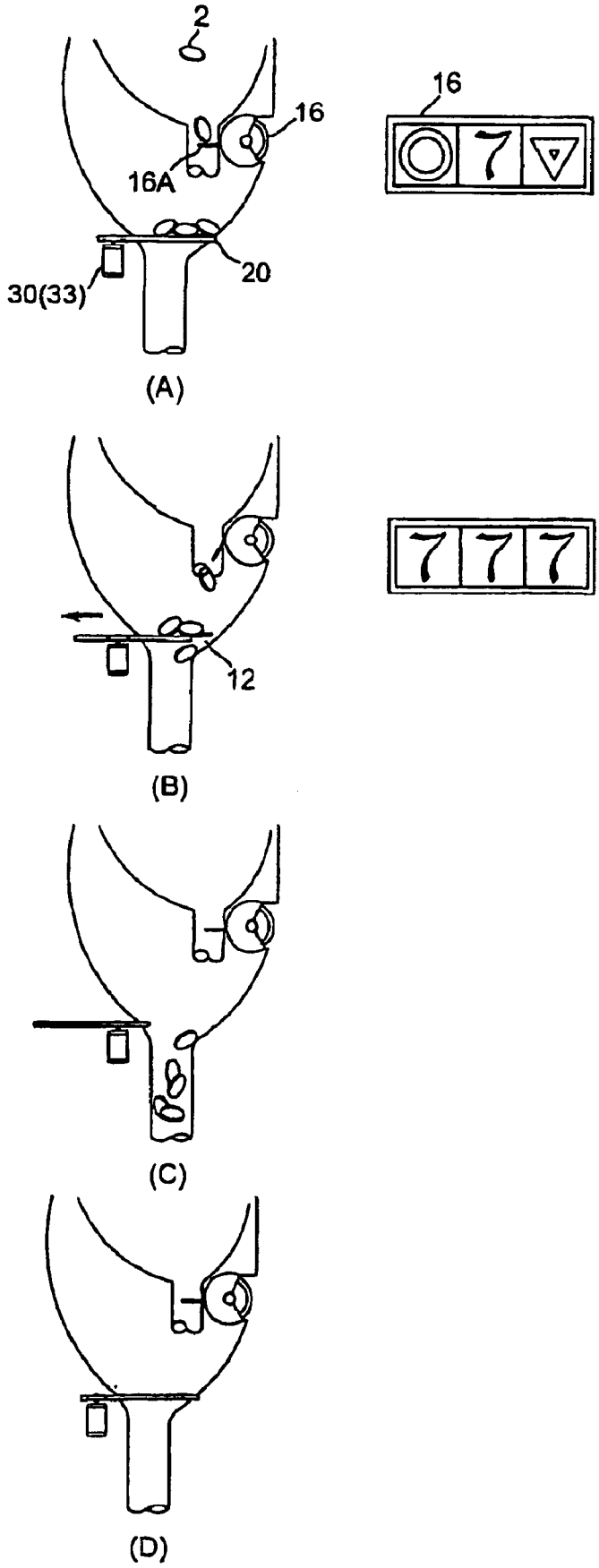
FIG. 11 illustrates an operation procedure of the slot machine adapted to the coin bank.

Referring to FIGS. 9 to 11, the coin bank 1C of the third embodiment is described in detail as follows:

The coin bank 1C comprises a body 10 equipped with a slot machine 16, a shutter 20, and a shutter operating mechanism 30. When a coin enters into the body 10, the coin initiates the operation of the slot machine 16 by passing behind the slot machine 16.

If all three images or digits appearing on the display blocks of the slot machine 16 were not matched, the coin 2 would fall into the bottom of the body 10. If all three images or digits appearing on the display blocks of the slot machine 16 were matched, all coins accumulated so far are discharged from the body 10 into the coin saving container.

As well known to the public, the slot machine is an amusement device equipped with three individually rotating cylinders that display a certain number or image on each block of three in a row. When a player inserts a token or a coin and pulls the lever, the three cylinders start rotating to display a picture or number at each display block in the row. As a player releases the lever, an image or number appears on each displaying block. If the images or numbers are all the same, the player wins the game and the tokens or coins pour down as a prize. The amount of the prize varies depending on the probability of appearance of the winning combination of images.

The third embodiment of the present invention has adopted a simplified slot machine that is designed to be operated by the entering coin. As the coin passes behind the slot machine 16, the cylinders are rotated to display a digit or picture on the displaying window of the body 10. If there are three of the same images or digits of the lower probability appeared on the displaying window, the shutter operation mechanism 30 activates the shutter 20. Then the accumulated coins are drained into to the coin outlet 12 of the body 10. The simplified slot machine may have many images and digits. However, this simplified device of the present invention includes only several pictures and digits.

In the same manner as the previous embodiments, the coin outlet 12 of the body 10 is blocked by the shutter 20 that is operated by the shutter operating mechanism 30.

As shown in FIGS. 10 to 11, the shutter and shutter operating mechanism of the coin bank are identical to those of the first and second embodiment, excluding the connecting mechanism to the slot machine 16.

Referring to FIGS. 10 and 11, the operation of the shutter 20 and the shutter operating mechanism 30 is described in detail as follows: When a coin 2 is thrown into the body 10, a sensor 16A detects the entrance of the coin while it passes behind the slot machine 16. As the sensor transmits a signal to the control unit, the slot machine 16 is initiated to display the game result. If the three images displayed on the display window are not the same, the shutter operating mechanism 30 does not activate the shutter 20 and keeps blocking the coin outlet 12 (Referring to A of FIG. 11). If the three images displayed on the display window are the same, the control unit 35 activates the shutter operating mechanism 30 to open the shutter (Referring to B of FIG. 11).

Then, the control unit 35 activates the driving device 33 to open the shutter 20 for a preset time, so the coins accumulated on the bottom of the body 10 are discharged (Referring to C of FIG. 11). After a short time has elapsed, the control unit 35 reverses the driving device 33 to restore the shutter 20 to the original position. Thereby, the slot machine is ready to play the next game (Referring to D of FIG. 11).

The coin bank 1C may be equipped with a flashing light 50, a sound generator 60 and a dancing doll 70 for event performance in the same manner as described in the previous embodiments.

On the other hand, it is possible to adopt another game means to the coin bank 1 of the present invention. For example, a rotating device that could be rotated by the weight of the coin may be installed in the body 10 such that the shutter operating mechanism and the shutter are operated when the rotation device stops at a section of lower probability.

In addition, it is also possible to install two or more amusement devices for performing various events at the same time, such as a coin throwing game with a success section and fail section, a bingo game plate, a slot machine and a rotation device adapted in the present invention. For example, a combination of the slot machine 16 and the bingo plate 15 can be installed in the upper and lower portions of the body 10. When a coin enters the body, it first operates the slot machine and next performs the bingo game. In this situation, it would have more chances to win the game because one coin plays two games, the winning possibility is doubled and either the slot machine game or the bingo game could be won by one throwing of the coin.

As described so far, a coin 2 could be saved while providing amusement such as a coin toss game. Even if the coin is wrongly thrown and falls off-target, the coins are accumulated on the bottom of the body 10. If a coin hits the target to be a winning coin, the accumulated coins are discharged into a saving container with a performance celebrating the event, such as flashing a light, generating a second message, and operating a dancing doll. Therefore, it is possible to stimulate the children to save money with a joyful mind.

Accordingly, the coin bank 1 of the present invention is distinct from the conventional coin bank by employing a coin playing game. Thus, it is possible to spontaneously encourage the children to save, while it can be used as a recreational device.

While the embodiments of the present invention have been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coin bank having a recreational function, comprising:

a body (10) comprising of a target hole (13) as a success section, a coin receiving part (14) with an open top (11) as a fail section and a coin outlet (12) for discharging previously thrown and accumulated coins, wherein said target hole (13) forms a funnel shape and is located inside of said coin receiving part (14), a shutter (20) for blocking said coin outlet (12), a shutter operating mechanism (30) for activating said shutter (20), a plurality of transparent pipes (41) and a base cap (42) that are coupled each other and vertically extended for supporting said body (10), wherein said transparent pipes (41) are used as a coin storing container (40), and a control unit (35) consisting of a driving motor (33), at least one sensor (31), an illuminating light (50), a voice generator (60) and an event performer (70).

2. A coin bank having a recreational function according to claim 1, wherein said illuminating light (50) is a flashing light, said source generator (60) delivers a voice message and said event performer (70) is a dancing doll, and at least one of the light (50), sound generator (60) or event performer (70) is simultaneously operated with said shutter (20).

3. A coin bank having a recreational function according to claim 1, wherein said sensor (31) is either a contacting point sensor or an optical sensor.

4. A coin bank having a recreational function according to claim 1, wherein said body further comprises a simplified bingo grid plate for performing a simplified bingo game.

5. A coin bank having a recreational function according to claim 1, wherein said body further comprises a simplified slot machine for performing a simplified slots game.

* * * * *